US007153241B2

(12) United States Patent
Wang

(10) Patent No.: US 7,153,241 B2
(45) Date of Patent: Dec. 26, 2006

(54) ELECTRIC TREADMILL

(76) Inventor: Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 0 days.

(21) Appl. No.: 11/224,637

(22) Filed: Sep. 13, 2005

(65) Prior Publication Data

US 2006/0009333 A1 Jan. 12, 2006

Related U.S. Application Data

(63) Continuation-in-part of application No. 09/467,224, filed on Dec. 20, 1999, now Pat. No. 6,179,754, and a continuation-in-part of application No. 09/247,571, filed on Feb. 10, 1999, now Pat. No. 6,126,575.

(51) Int. Cl.
*A63B 22/00* (2006.01)
*A63B 21/00* (2006.01)

(52) U.S. Cl. ..... 482/54; 482/51; 482/8

(58) Field of Classification Search ..... 482/1–9, 482/51, 54

See application file for complete search history.

(56) References Cited

U.S. PATENT DOCUMENTS 4,708,337 A * 11/1987 Shyu ..... 482/54
5,314,391 A * 5/1994 Potash et al. ..... 482/7
5,368,532 A * 11/1994 Farnet ..... 482/54

* cited by examiner

*Primary Examiner*—Glenn E. Richman

(57) ABSTRACT

The present invention relates to an electric treadmill in which the tread base neighboring upon the running belt and based upon the central reference point is provided with sensing lines for acceleration, sensing lines for deceleration both of which are arranged one after the other. When the runner touches the fixed sensing position by light wave or acoustic wave, a CPU located within the electric console gives a command according to the sensing position to accelerate or decelerate the motor such that an immediate control of the rotational speed of the running belt is achieved. In addition, a sensing line for stop can be disposed behind the decelerating sensing line. When the operator continues to be shifted forwards, thereby contacting with the sensing line for stop, CPU gives a command to stop the motor immediately. Thus, the safety of the operator can be more ensured.

10 Claims, 2 Drawing Sheets

ELECTRIC TREADMILL

BACKGROUND OF THE INVENTION

1. Fields of the Invention

The present invention relates to an electric treadmill, and more particularly, to a device which is provided with a plurality of fixed sensing lines. When the operator touches one of them, a command is given to accelerate, decelerate or stop the operation of the treadmill.

2. Description of the Prior Art

First of all, it is noted that the present invention is continuation-in-part of Ser. No. 09/247,571 filed Feb. 10, 1999 now U.S. Pat. No.6,126,575 and 09/467,224 filed Dec. 20, 1999 now U.S. Pat. No. 6,179,754 (hereinafter called "the first prior art" and "the second prior art"). It's described in the first prior art that an automatic roll-up rope is tied around the operator's body. In addition, a sensor is disposed to detect the position of the runner. After a central processing unit processes the detection parameters, a command is given to accelerate or decelerate the motor.

The second prior art describes that a detector is fitted to both sides of the tread base for detecting the position of the runner. After a central processing unit processes the detection parameters, a command is given to accelerate or decelerate the motor.

In brief, the central processing units of both prior arts are used to evaluate the detection parameters to obtain the exact position of the runner. Thereafter, a command is given to accelerate or decelerate the motor. Consequently, the motor reacts after the steps of the runner or the body displacement. Although both prior arts can obtain more accurate parameters to give command for accelerating or decelerating the motor, this is the reason why difficulties are caused in programming and in cooperation with other components. Therefore, the production costs thereof are considerably increased and the price thereof is always kept in a high level.

SUMMARY OF THE INVENTION

Therefore, it is a primary object of the present invention to eliminate the above-mentioned drawbacks and to provide an electric treadmill which is provided with a plurality of fixed sensing lines. When the operator touches one of them, a command is given to accelerate, decelerate or stop the operation of the treadmill. Thus, the operation procedure of the central processing unit is tremendously simplified to efficiently increase the ability of the instant reaction.

It's another object of the present invention to provide an electric treadmill which can considerably reduce the production cost by means that a more simple and cheaper central processing unit is used to automatically accelerate and decelerate the motor.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Before dealing with features of the present invention, the applicant has to give a brief description about the walking, jogging or running exercise on the electric treadmill in order to understand the basic control principles of the present invention.

1. The position of the runner is unchanged when the running speed of the operator is equal to the rotational speed of the running belt.
2. The position of the runner is shifted forwards when the running speed of the operator is higher than the rotational speed of the running belt.
3. The position of the runner is shifted backwards when the running speed of the operator is lower than the rotational speed of the running belt.

Accordingly, the position of the operator will be changed in accordance with his running speed when he stands at the center of the running belt.

Figure 1:
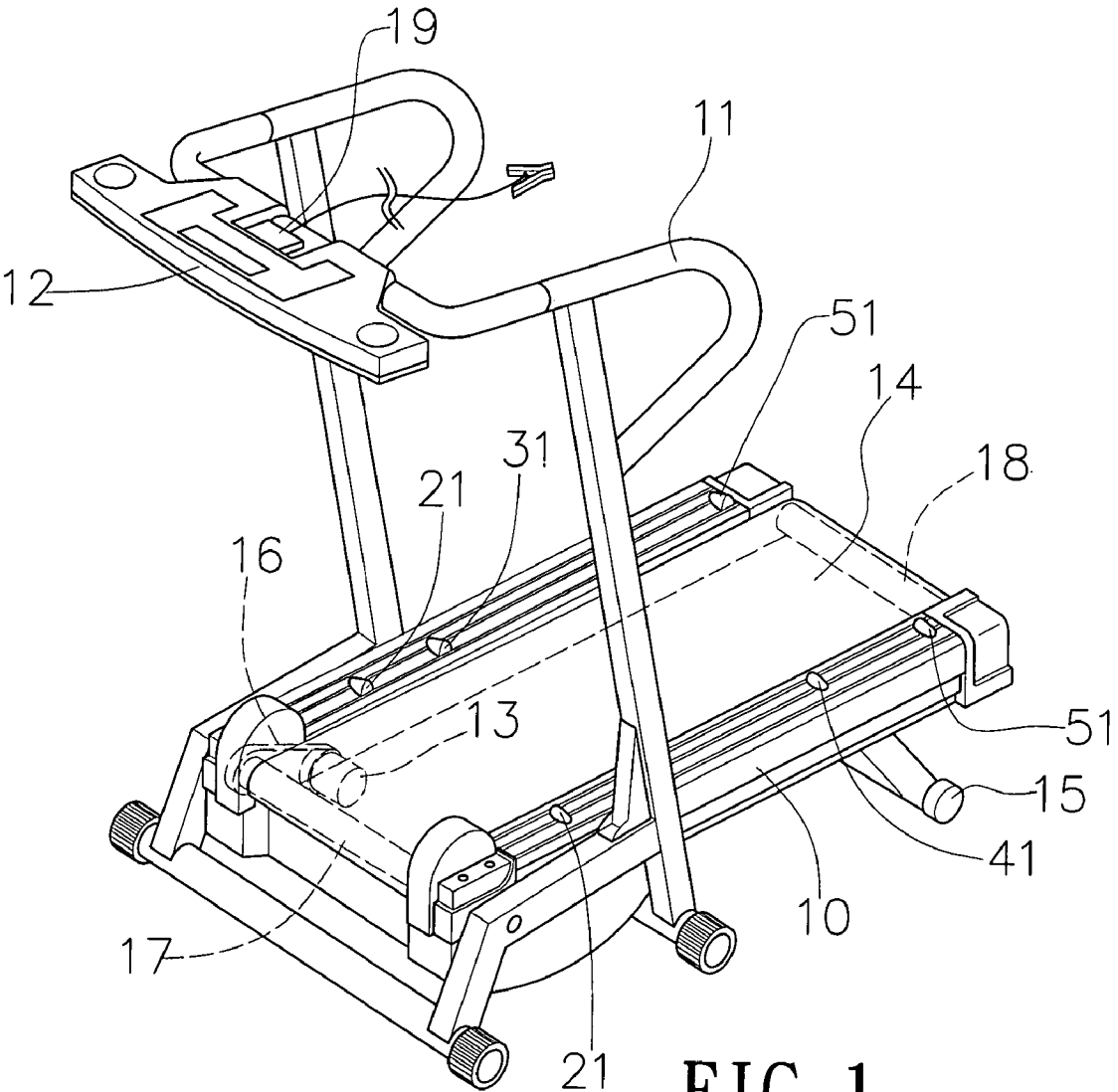
FIG. 1 is a perspective view of a preferred embodiment of the present invention.
Figure 2:
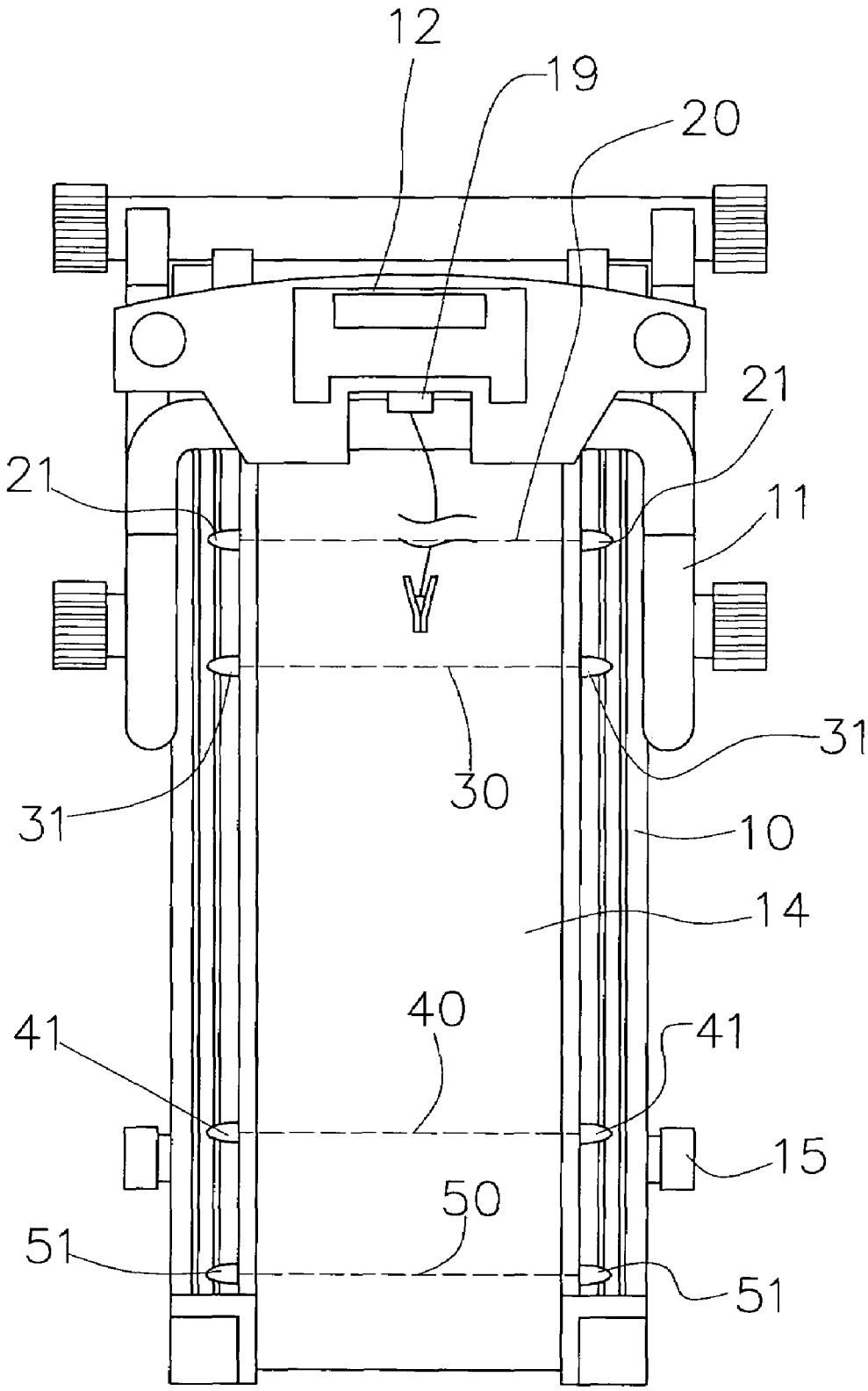
FIG. 2 is a top view in accordance with FIG. 1, illustrating the position of the sensing lines.

As shown in FIGS. 1 and 2, the electric treadmill includes a tread base 10, a handrail 11, an electric console 12, a motor 13, a running belt 14 and a rear support 15. The motor 13 brings a drive belt 16 into rotation which drives a front roller 17. The running belt 14 is placed around the front and rear rollers 17, 18, thereby creating an endless rotation by means of the operation of the motor 13.

Based on the central reference point, the tread base 10 neighboring upon the running belt 14 is provided with a multiple accelerating sensing line 20, a basic accelerating sensing line 30 and a decelerating sensing line 40 three of which are arranged one after another. When the runner touches the fixed sensing position by light wave or acoustic wave, a CPU located within the electric console 12 gives a command according to the sensing position to accelerate or decelerate the motor 13. Accordingly, an immediate control of the rotational speed of the running belt 14 is achieved.

The operation principle and method of the sensing lines 20, 30, 40 are shown in FIG. 2. The sensing lines 20, 30, 40 are created by means that the sensing elements 21, 31, 41 (e.g. infrared rays, laser rays, radar waves, etc.) each send out a straight signal crossing through said tread base 10 (see dashed line in FIG. 2), respectively. When one signal of the sensing lines 20, 30, 40 senses the appearance of the operator, CPU will immediately and automatically send out a command to perform the speed control of the motor 13.

Accordingly, an optimal position of the operator is at the center of the running belt 14 when the running speed of the operator is equal to the rotational speed of the running belt. The position of the runner is shifted forwards when the running speed of the operator is higher than the rotational speed of the running belt 14, thereby contacting with basic accelerating sensing line 30. Therefore, the motor 13 is accelerated according to the preset value. The position of the runner is shifted more forwards when the running speed of the operator is still higher than the rotational speed of the running belt 14 after the first adjustment, thereby contacting the multiple accelerating sensing line 20. Thus, the motor will be accelerated once again. The motor 13 won't be accelerated only if the operator doesn't contact the sensing lines 20, 30 any more. On the other hand, when the running speed of the operator is lower than the rotational speed of the running belt 14, the position of the runner is shifted backwards to contact with the decelerating sensing line 40. Immediately, the motor 13 won't be decelerated only if the operator doesn't contact with the decelerating sensing line 40 any more.

In brief, the central position of the running belt 14 stands for the normal exercise position, that is, the exercise state when the running speed and the speed of the running belt 14 are identical. The sensing lines 20, 30, 40 are arranged based on the reference point of the normal exercise position. The multiple accelerating sensing line 20 differs from the basic accelerating sensing line 30 by the running speed of the operator. That is, when the running speed is gradually increased, the motor 13 is correspondingly accelerated (at the basic acceleration). When the running speed is sharply increased, the motor 13 is correspondingly accelerated (at the multiple acceleration) to meet the exercise needs. Similarly, when the running speed is decreased, the motor 13 is correspondingly decelerated.

Besides, a sensing line 50 for stop can be disposed behind the decelerating sensing line 40. When the operator continues to be shifted forwards, thereby contacting with the sensing line 50 for stop, CPU gives a command to stop the motor 13 immediately. Thus, the safety of the operator can be more ensured.

In fact, the sensing line 50 for stop (with the sensing element 51) can be individually fitted to any electric treadmill and replace the safety pin 19 for disconnection. Of course, both safety devices (the sensing line 50 for stop and the safety pin 19 for disconnection) can be used together for a double safety effect.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An electric treadmill comprising a tread base, a handrail, an electric console, a motor, a running belt and a rear support, said motor bringing a drive belt into rotation which drives a front roller, said running belt being placed around said front and rear rollers, thereby creating an endless rotation by means of the operation of said motor;

wherein, based upon a central reference point, said tread base neighboring upon said running belt is provided with sensing lines for acceleration, sensing lines for deceleration both of which are arranged one after the other, and wherein, when the runner touches one of the sensing lines by altering a light wave or an acoustic wave from a sensing element, a CPU located within said electric console gives a command according to the sensing line touched to accelerate or decelerate said motor so that an immediate control of the rotational speed of said running belt is achieved, wherein said sensing lines for acceleration are divided into at least one additional accelerating sensing line and a basic accelerating sensing line and said sensing lines for deceleration are divided into at least one additional decelerating sensing line and a basic decelerating sensing line.

2. The electric treadmill of claims 1, wherein said central reference point is located in a center position of said running belt.

3. The electric treadmill of claims 1, wherein said sensing elements of said sensing lines each send out a straight signal crossing through said tread base.

4. The electric treadmill of claims 1, wherein said sensing lines for acceleration, said motor, and said CPU are configured to sharply accelerate said motor when one of said at least one additional accelerating sensing lines is contacted by the runner and to more gradually accelerate the motor when said basic accelerating sensing line is contacted by the runner.

5. The electric treadmill of claims 4, wherein said sensing lines for deceleration, said motor, and said CPU are configured to sharply decelerate said motor when one of said at least one additional decelerating sensing lines is contacted by the runner and to more gradually decelerate the motor when said basic decelerating sensing line is contacted by the runner.

6. An electric treadmill comprising a tread base, a handrail, an electric console, a motor, a running belt and a rear support, said motor bringing a drive belt into rotation which drives a front roller, said running belt being placed around said front and rear rollers, thereby creating an endless rotation by means of the operation of said motor;

wherein, based upon a central reference point, said tread base neighboring upon said running belt is provided with sensing lines for acceleration, sensing lines for deceleration and a sensing line for stop, all three of which are arranged one after another, and wherein, when the runner touches one of the sensing lines by altering light wave or an acoustic wave from a sensing element, a CPU located within said electric console gives a command according to the sensing line touched to accelerate, decelerate or stop said motor so that an immediate control of the rotational speed of said running belt is achieved, wherein said sensing lines for acceleration are divided into at least one additional accelerating sensing line and a basic accelerating sensing line and said sensing lines for deceleration are divided into at least one additional decelerating sensing line and a basic decelerating sensing line.

7. The electric treadmill of claims 6, wherein said central reference point is located in a center position of said running belt.

8. The electric treadmill of claims 6, wherein said sensing elements of said sensing lines each send out a straight signal crossing through said tread base.

9. The electric treadmill of claims 6, wherein said sensing lines for acceleration, said motor, and said CPU are configured to sharply accelerate said motor when one of said at least one additional accelerating sensing lines is contacted by the runner and to more gradually accelerate the motor when said basic accelerating sensing line is contacted by the runner.

10. The electric treadmill of claims 9, wherein said sensing lines for deceleration, said motor, and said CPU are configured to sharply decelerate said motor when one of said at least one additional decelerating sensing lines is contacted by the runner and to more gradually decelerate the motor when said basic decelerating sensing line is contacted by the runner.

* * * * *